US006144821A

United States Patent [19]

Oguma

[11] Patent Number: 6,144,821

[45] Date of Patent: Nov. 7, 2000

[54] SHUTTER MEMBER AND PROCESS CARTRIDGE

[75] Inventor: Toru Oguma, Mishima, Japan

[73] Assignee: Canon Kabushiki Kaisha, Tokyo, Japan

[21] Appl. No.: 09/392,303

[22] Filed: Sep. 8, 1999

[30] Foreign Application Priority Data

Sep. 11, 1998 [JP] Japan ..... 10-276617

[51] Int. Cl.[7] ..... G03G 15/00; G03G 21/18

[52] U.S. Cl. ..... 399/114

[58] Field of Search ..... 399/114, 110, 399/111

[56] References Cited

U.S. PATENT DOCUMENTS

| | | | |
|---|---|---|---|
| 4,462,677 | 7/1984 | Onoda | 399/114 |
| 4,470,689 | 9/1984 | Nomura et al. | 399/114 |
| 5,455,665 | 10/1995 | Baba et al. | 355/298 |
| 5,697,017 | 12/1997 | Rooke et al. | 399/114 X |
| 5,768,658 | 6/1998 | Watanabe et al. | 399/111 |
| 5,790,923 | 8/1998 | Oguma et al. | 399/106 |
| 5,812,909 | 9/1998 | Oguma et al. | 399/103 |

*Primary Examiner*—Joan Pendegrass
*Attorney, Agent, or Firm*—Fitzpatrick, Cella, Harper & Scinto

[57] ABSTRACT

A shutter member used for a process cartridge detachably mountable to a main body of an electrophotographic image forming apparatus, includes: a shutter part for partly covering an electrophotographic photosensitive drum of the process cartridge when mounted to the process cartridge; a supporting member with its distant end attached to a frame of the process cartridge for supporting the shutter part on the process cartridge; and first and second attachment parts provided at the shutter part for attaching the supporting member. The first attachment part and the second attachment part differ in attachment direction for attaching the supporting member.

20 Claims, 7 Drawing Sheets

SHUTTER MEMBER AND PROCESS CARTRIDGE

BACKGROUND OF THE INVENTION

1. Field of the Invention

The present invention relates to a shutter member for protecting an electrophotographic photosensitive member pertaining to a process cartridge detachably mountable to a main body of an image forming apparatus and a process cartridge with this shutter member, detachably mountable to a main body of an image forming apparatus.

2. Related Background Art

Thus far, in the image forming apparatuses using an electrophotographic image forming process, there has been adopted a process cartridge model in which an electrophotographic photosensitive member and process means acting on the electrophotographic photosensitive member are integrated into a cartridge, and this process cartridge is allowed to be detachably mountable to the main body of the image forming apparatus. According to this process cartridge model, since the maintenance of an apparatus is performable by a user himself rather than by a service man, the operativity could be remarkably enhanced. Thus, this process cartridge model is widely used in the image forming apparatuses.

Some of such process cartridges are provided with a shutter member for protecting an electrophotographic photosensitive member when detached from a main body of an image forming apparatus.

The above shutter member is so arranged as to be opened in linkage with the mounting operation of a process cartridge on a main body of an image forming apparatus. However, when an excessive force is applied to the link for supporting the shutter member openably and closably on the cartridge frame or when the shutter member interferes with the main body of the image forming apparatus, the link may come off the shutter member.

The present invention is a further developed product of the above-described earlier technology.

SUMMARY OF THE INVENTION

It is one object of the present invention to provide a shutter member capable of preventing the supporting member from coming off the shutter member and a process cartridge having the shutter member.

It is another object of the present invention to provide a shutter member capable of preventing the supporting member (link) from coming off in demounting a process cartridge from the main body of the image forming apparatus and a process cartridge having the shutter member.

It is yet another object of the present invention to provide shutter member comprising a first and a second attachment parts provided on a shutter member for attaching a supporting member, to the shutter member wherein the first and the second attachment parts differ in the attaching direction for the attachment of the supporting member, and a process cartridge having the shutter member.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 1A is a perspective view showing a combining relation of a drum shutter with an arm and a link, FIG. 1B is an enlarged sectional view showing a first support part in the drum shutter, and FIG. 1C is an enlarged sectional view showing a second support part in the drum shutter, respectively.

DETAILED DESCRIPTION OF THE PREFERRED EMBODIMENTS

Figure 1A:
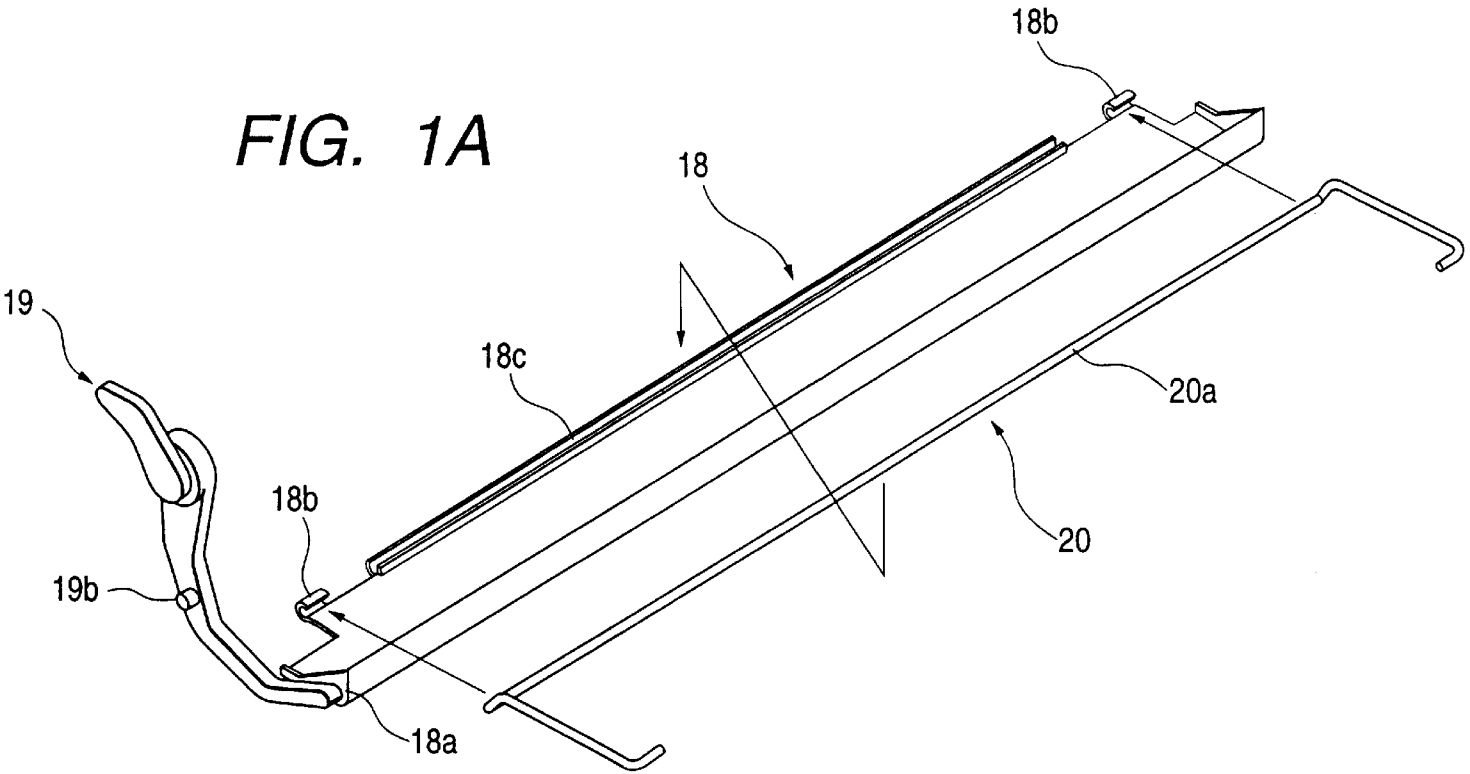
FIGS. 1A, 1B and 1C are views of a drum shutter according to EMBODIMENT 1 of the present invention.

Hereinafter, referring to the drawings, a shutter member, a process cartridge, and an image forming apparatus according to the present invention will be described.

In the following description, the term "short-side direction" refers to a mounting/demounting direction of a process cartridge to/from a main body of an image forming apparatus and coincides with a conveying direction of a recording medium. Besides, the term "long-side direction" of the process cartridge refers to a direction crossing (nearly perpendicular to) the mounting/demounting direction of the process cartridge to/from the main body of the image forming apparatus and crosses (is nearly perpendicular to) the conveying direction of the recording medium. The top and bottom surfaces of the process cartridge are surfaces positioned at the upper and lower sides of the process cartridge in a state in that the process cartridge is mounted on the main body of the image forming apparatus.

Embodiment 1:

(Configuration of an Electrophotographic Image Forming Apparatus)

Figure 2:
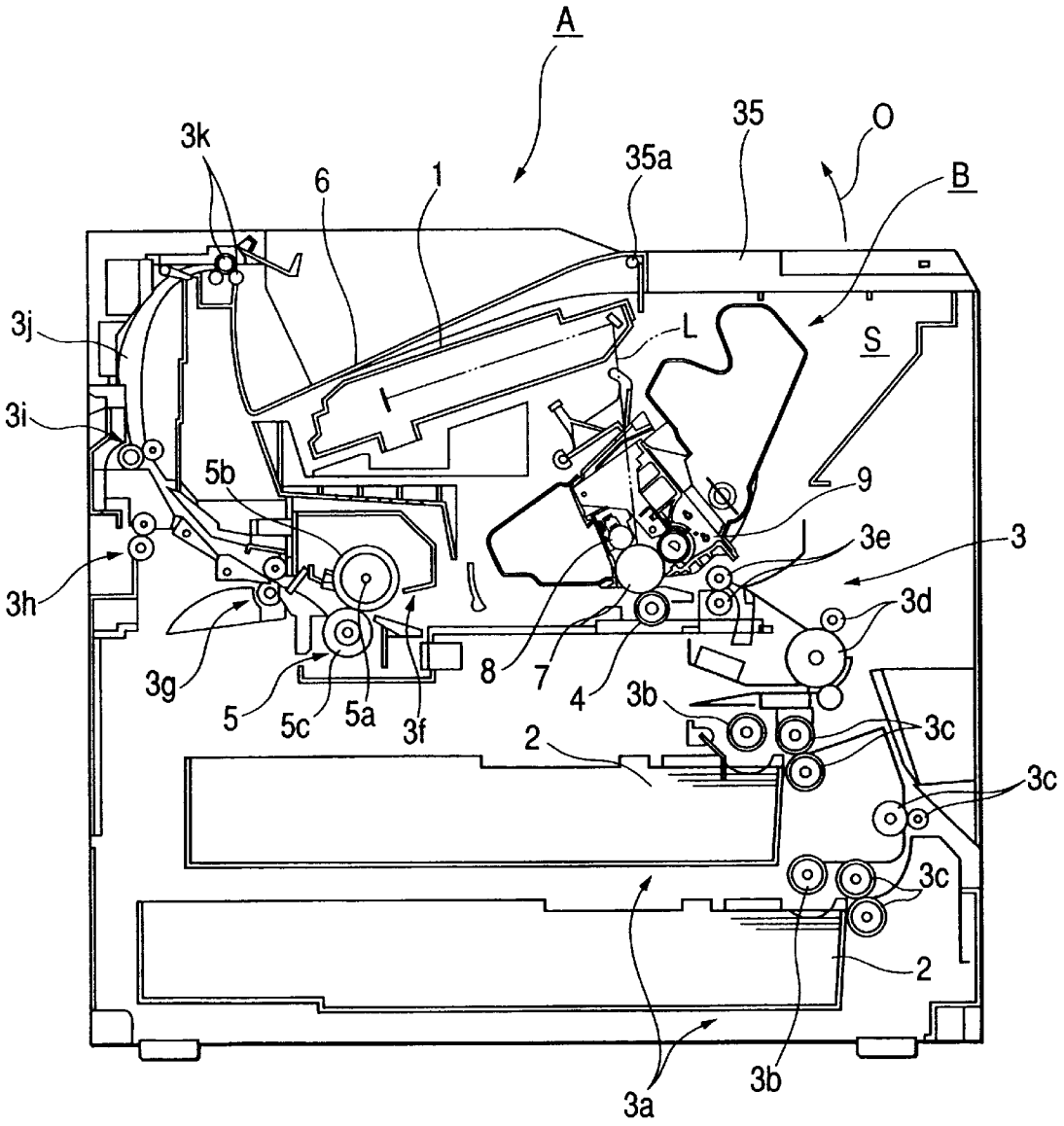
FIG. 2 is a sectional view of a main body of an image forming apparatus with a process cartridge in the mounting state according to EMBODIMENT 1.

First, with reference to FIG. 2, a laser beam printer A as an electrophotographic image forming apparatus to which the Embodiment 1 of the present invention is applied will be described. FIG. 2 is a sectional view of a main body of an image forming apparatus with a process cartridge mounted thereto.

This laser beam printer A serves to form images on a recording medium (such as, e.g. recording paper, OHP sheet or cloth) 2 by the electrophotographic image forming process. And for this purpose, a toner image (developer image) is formed on a drum-shaped electrophotographic photosensitive member (hereinafter, referred to as photosensitive drum) 7. To be specific, after a photosensitive drum 7 is charged by charging means 8, a laser beam, corresponding to an image information, irradiates from an optical system 1, to this photosensitive drum 7 to form a latent image corresponding to the image information on the photosensitive drum 7. And, in sync with a formation of the toner image, the recording medium 2 set on a sheet feeding cassette 3*a* is conveyed by conveying means 3 such as pickup roller 3*b*, pairs of conveying rollers 3*c*, 3*d* and pair of registration roller 3*e* and reversed a front surface and a back surface of the recording medium 2. Next, the toner image, formed on the photosensitive drum 7 pertaining to a process cartridge B, is transferred to the recording medium 2 by applying a voltage to a transfer roller 4 as transfer means. Then, the recording medium 2, having received the transfer of the toner image, is conveyed to fixing means 5 by a conveying guide 3*f* to fix the toner image. This fixing means 5 has a driving roller 5*c* and a fixing roller 5*b* with a heater 5*a* built therein and fixes the transferred toner image on the passing recording medium 2 under the application of heat and pressure. And, this recording medium 2 is conveyed by the pairs of discharge rollers 3*g*, 3*h* and 3*i* and discharged through a surface reverse path 3*j* to a discharge tray 6 provided on the top surface of the main body A of the apparatus by a pair of discharge rollers 3*k*. In this embodiment, the conveying means 3 is configured by the pickup roller 3*b*, the pairs of conveying rollers 3*c* and 3*d*, the pair of registration rollers 3*e*, the conveying guide 3*f*, the pairs of discharge rollers 3*g*, 3*h* and 3*i*, the surface reverse path 3*j*, the pair of discharge rollers 3*k*, etc.

(Configuration of Process Cartridge)

Figure 3:
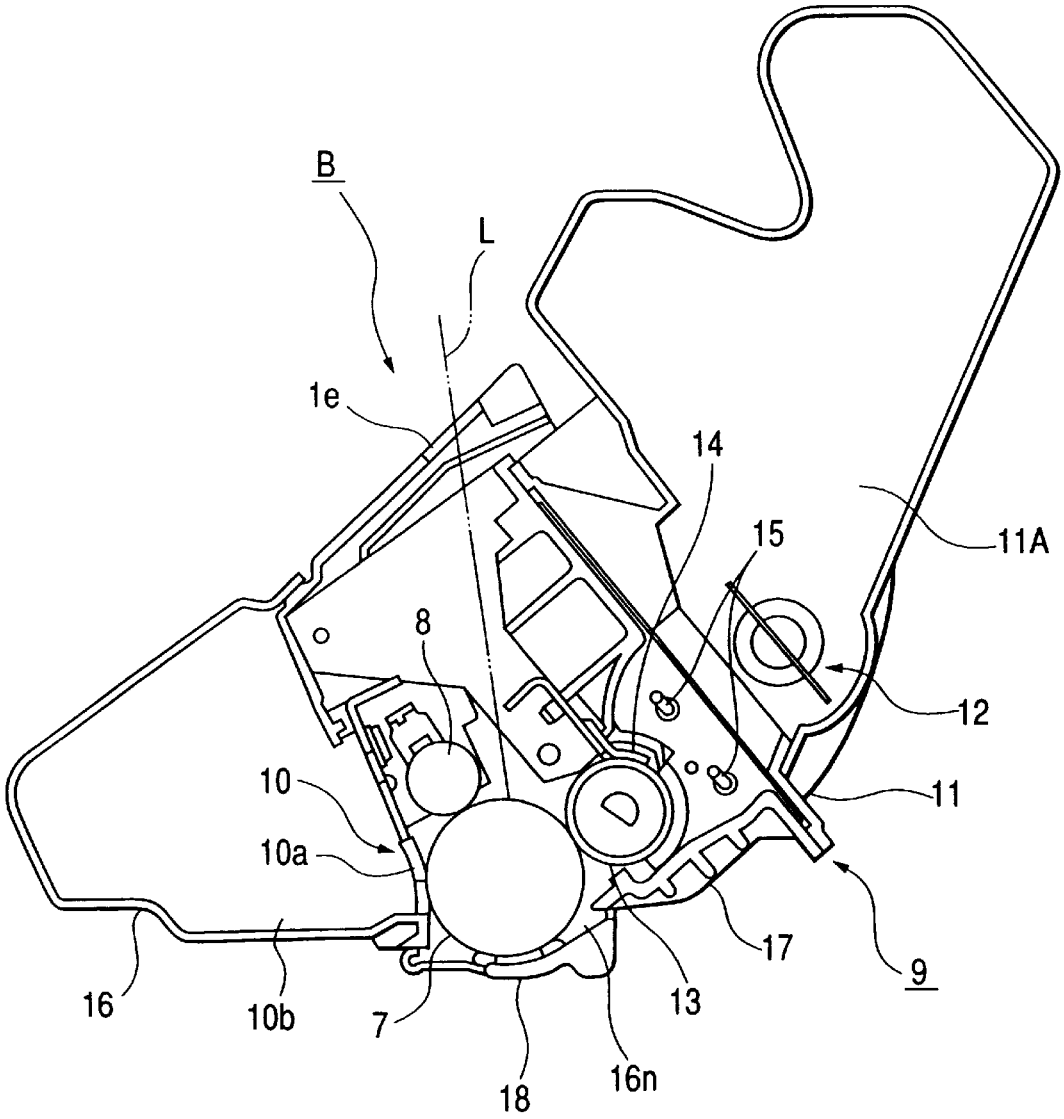
FIG. 3 is a sectional view of a process cartrige according to EMBODIMENT 1.
Figure 4:
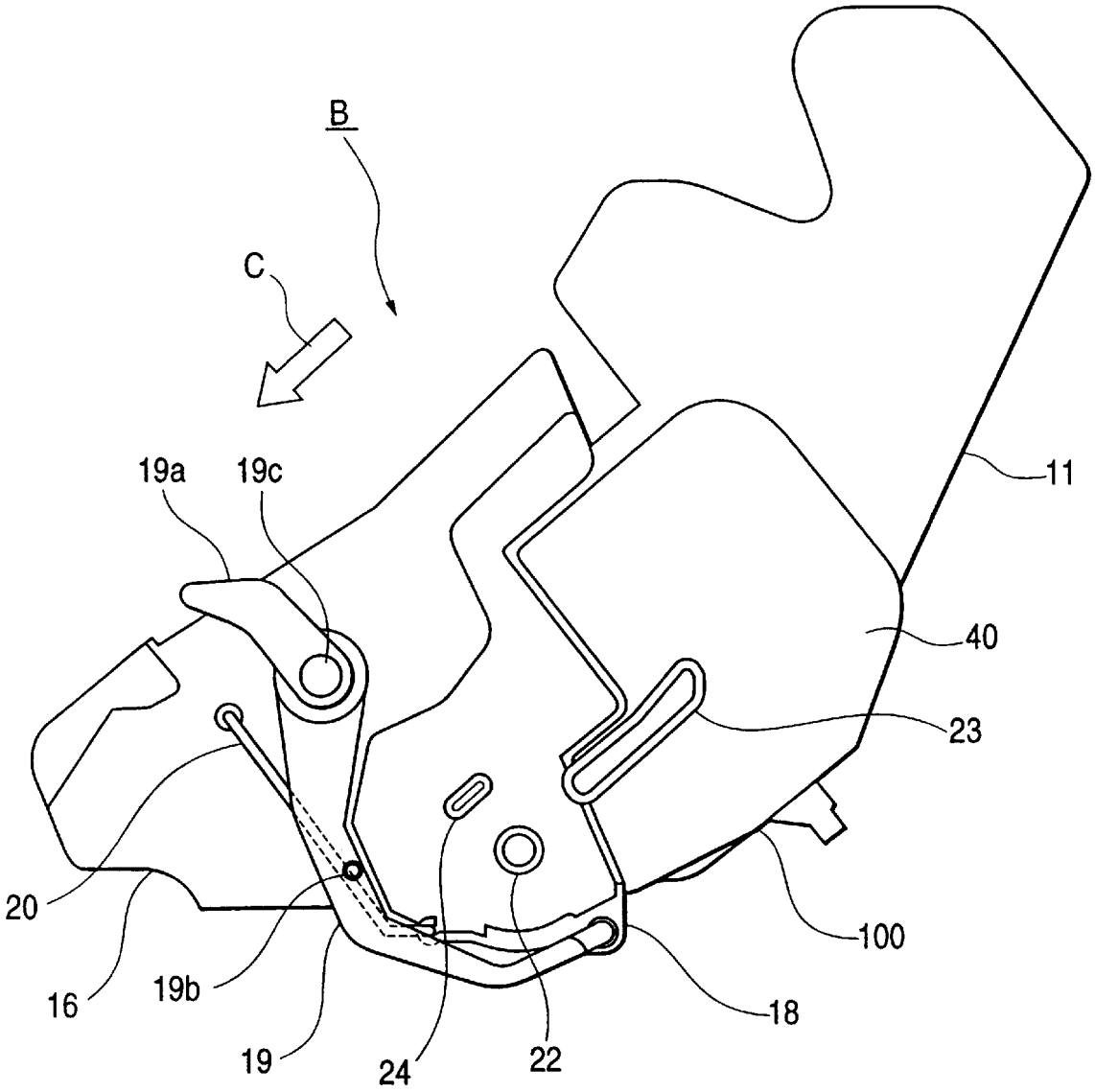
FIG. 4 is a side view of a process cartrige according to EMBODIMENT 1.

Next, a description will be provided of a process cartridge B with reference to FIGS. 3 and 4. FIGS. 3 and 4 are sectional and side views of the process cartridge B, respectively.

The process cartridge B comprises an electrophotographic photosensitive member and at least one process means acting on the electrophotographic photosensitive member. Here, the process means includes, for example, charging means for charging the electrophotographic photosensitive member, developing means for developing a latent image formed on the electrophotographic photosensitive member and cleaning means for cleaning the toner remaining on the surface of the electrophotographic photosensitive member.

A process cartridge B according to EMBODIMENT 1, as shown in FIG. 3, rotates the photosensitive drum 7, as an electrophotographic photosensitive member with a photosensitive layer, as an image bearing member, and uniformly charges its surface under the application of a voltage to the charging roller (charging means) 8 rotated by the photosensitive drum 7. Namely, the charging roller 8, provided in contact with the photosensitive drum 7, charges the photosensitive drum 7. Next, a laser beam L, corresponding to the image information from the optical system 1, irradiates to the photosensitive drum 7 via an exposure aperture portion 1*e* to form a latent image. And, this latent image is developed with toner (developer) by developing means 9.

Here, the developing means 9 feeds out the toner in a toner container 11A to a developing roller 13 by rotation of a toner feeding member 12. And together with rotation of the developing roller 13 with a stationary magnet built therein, a toner layer with a tribo-electric charge, imparted by a developing blade 14, is formed on the surface of the developing roller 13 and the toner is supplied to the developing region of the photosensitive drum 7. And, the toner is transferred to the photosensitive drum 7 in accordance with the latent image to form a toner image for visualization. Here, the developing blade 14 serves to regulate the toner amount on the peripheral surface of the developing roller 13. Besides, near this developing roller 13, an agitating member 15 for circulating the toner in a developing chamber is provided rotatably. And, after the toner image formed on the photosensitive drum 7 is transferred to the recording medium 2 under the application of a voltage opposed in polarity to the toner image onto the transfer roller 4, the residual toner on the photosensitive drum 7 is removed by cleaning means 10 to be made ready for the subsequent step. Here, the cleaning means 10 scrapes off the residual toner on the photosensitive drum 7 with the aide of an elastic cleaning blade 10*a* provided to abut against the photosensitive drum 7 and collects the removed toner to a waste toner reservoir 10*b*.

Incidentally, components such as photosensitive drum 7 and cleaning means 10 are housed in a cleaning frame 16. The cleaning frame 16 is joined with a developing frame 11 joining a toner container 11A and a developing container 17 to make a cartridge as process cartridge B. The process cartridge B is detachably mountable to the main body A of the apparatus.

In other words, as for the process cartridge B, the toner container 11A for containing toner and the developing container 17 for holding the developing means 9, such as developing roller 13, are joined to make the developing frame 11. The cleaning frame 16, to which a photosensitive drum 7, the cleaning means 10 such as cleaning blade 10*a* and the charging roller 8 are attached, is joined with this developing frame 11 to constitute the process cartridge B. And, this process cartridge B is detachably mountable to the main body A of the apparatus for an operator.

Provided at this process cartridge B are an exposure aperture portion 1*e* through which a laser beam L in accordance with image information irradiates to the photosensitive drum 7, and a transfer aperture portion (opening portion) 16*n* through which the photosensitive drum 7 is opposed to a recording medium 2. To be specific, the exposure aperture portion 1*e* is provided at the cleaning frame 16, whereas the transfer aperture portion 16*n* is constructed between the developing frame 11 and the cleaning frame 16.

Next, the configuration of a housing for a process cartridge B according to EMBODIMENT 1 will be described.

The process cartridge B shown in this embodiment is obtained such that the toner container 11A and the developing container 17 are joined to make the developing frame 11, and then in a housing, as a cartridge frame made up by joining the cleaning frame 16 rotatably with this developing frame 11, are housed the photosensitive drum 7, the charging roller 8, the developing means 9, the cleaning means 10, etc., so as to be made into a cartridge. And, this process cartridge B is detachably mountable to the mounting guide (cartridge mounting means) 21 mentioned later provided at the main body A of the apparatus.

Besides, mounted to the process cartridge B is a drum shutter 18, as a shutter member, for covering the photosensitive drum 7 and protecting the photosensitive drum 7 from the exposure to light for a long time, from contact with foreign matter, or the like when the process cartridge B is removed from the main body A of the apparatus. The drum shutter 18 is supported on the cleaning frame 16 by an arm 19 and a link 20 and opens and closes the transfer aperture portion 16*n* in association with the mounting and demounting operations of the process cartridge B (See FIG. 4).

(Configuration of Drum Shutter (Shutter Member))

As shown in FIG. 4, this drum shutter 18 is pivoted and supported at the respective distant ends of the arm 19 and the link 20 respectively supported rotatably on the cleaning frame 16. This drum shutter 18 opens by sliding contact of the distant end of the lever 19*a* with the proximate end of the lever 19*a* fixed to the arm 19 at the fulcrum 19*c* of the arm 19 made with the first cam 21*c* mentioned later of the mounting guide 21 when mounting the process cartridge B to the main body A of the apparatus in the direction of the arrowhead C in FIG. 4 and closes under action of an elastic force of a torsion spring (unshown) provided at the fulcrum 19*c* when removing the process cartridge B from the main body A of the apparatus. In FIG. 4, a protrusion 19*b*, provided on the arm 19, regulates the movement of the arm 19 by its contact with the second cam 21*d* mentioned later of the mounting guide 21 during the opening operation step of the drum shutter 18.

The configuration of the drum shutter 18, the arm 19 and the link 20 will be further described. As shown in FIG. 1A, the distant end of the arm 19 is rotatably attached in snap fitting to a hole 18*a* provided at the one end portion on the side of the developing roller 13 in the short-side direction of the drum shutter 18. Besides, with first support parts 18*b* for rotatably supporting a shutter shaft 20*a* of a planar nearly U-shaped link 20 that opens and closes the drum shutter 18 relative to the photosensitive drum 7 in association with the mounting and demounting operation of the process cartridge B is provided at both ends in long-side direction on the side of the cleaning frame 16 in the short-side direction and a second support part 18*c* formed at the center of these both first support parts 18*b*, the drum shutter 18 is so arranged as to rotatably support the center of the shutter shaft 20*a*.

Figure 1B:
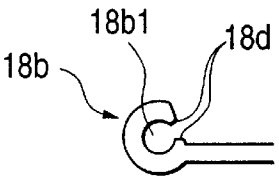

The sectional shape of the first supporting part 18*b* is shown in FIG. 1B and has a cut-away portion 18*b*1 in which a part is cut away nearly horizontally at the mounting posture of the process cartridge B to receive the shutter shaft 20*a* of the link 20. And at the opening ends of the cut-away portion 18*b*1 for the first support part 18*b*, snap fit nails (protrusive portions) 18*d* are provided for preventing the shutter shaft 20*a* of the link 20 from coming off.

Figure 1C:
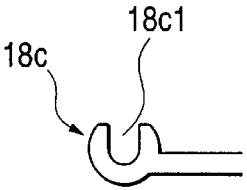

On the other hand, the sectional shape of the second support part 18*c* is shown in FIG. 1C and has a cut-away portion 18*c*1 in which a part is cut away nearly vertically at the mounting posture of the process cartridge B to receive the shaft 20*a* of the link 20.

That is, as understood from FIGS. 1B and 1C, two kinds of supporting parts 18*b* and 18*c* support the whole circumference of the shutter shaft 20*a* of the link 20 by the partial provision of the cut-away portions 18*b*1 and 18*c*1 different in the direction of a cut-away.

(Configuration of Guide Means in Process Cartridge)

Next, the guide means in the mounting/demounting of the process cartridge B to/from the main body A of the apparatus will be described. Incidentally, this guide means is illustrated in FIG. 4. FIG. 4 is a left side view of the process cartridge B as viewed in the direction of mounting to the main body A of the apparatus (direction of an arrowhead C).

Meanwhile, on both outer sides of the housing 100 as cartridge frame, as shown in FIG. 4, guide means is provided as serves for a guide when mounting/demounting the process cartridge B to/from the main body A of the apparatus. The guide means comprises a cylindrical guide 22 as a first guide member, an elongated guide 23 as a second guide member and a short guide 24 as a third guide member.

The above cylindrical guide 22, a cylindrical member, is so disposed at the side of the cleaning frame 16 as to protrude outward coaxially with an axis of the photosensitive drum 7. And, this cylindrical member supports the drum shaft (unshown) supporting the photosensitive drum 7 so that the drum shaft cannot rotate. Besides, the elongated guide 23 is so disposed at the side of the developing frame 11 so as to span the continuous side between the developing frame 11 and the cleaning frame 16. Furthermore, the short guide 24 is so disposed at the side of the cleaning frame 16 above the cylindrical guide 22. Here, the elongated guide 23 is integrated with the developing holder 40 fixed to the developing frame 11. Besides, the cylindrical guide 22 and the short guide 24 are integrally formed with the cleaning frame 16.

The elongated guide 23 extends in the inserting direction of the process cartridge (direction of the arrowhead C) and is so set as to keep its angle of the inclination identical to the inserting angle of the process cartridge B. On an extension line of the elongated guide 23, extending in the inserting direction of this process cartridge B, the cylindrical guide 22 is disposed. Besides, the short guide 24 is disposed in a direction substantially parallel to the elongated guide 23. Incidentally, the cylindrical guide 22, the elongated guide 23 and the short guide 24 are disposed in the same shape and at the same position also on the side opposite the side shown in FIG. 4. Besides, these three guides 22, 23 and 24 are so formed as to protrude from the outer plane of the cleaning frame 16 and the developing frame 11 at substantially the same height.

(Configuration of Cartridge Mounting Means in Main Body of Apparatus)

Next, a description will be provided of a mounting guide 21 as cartridge mounting means provided at the main body A of an apparatus to detachably mount the process cartridge B configured as mentioned above to the main body A of the apparatus.

As shown in FIG. 2, the cartridge mounting guides 21 are mounted to the right and left inner sides of the cartridge mounting space S appearing on the opening of an openable and closable member 35 around a fulcrum 35*a* made by an operator in the direction of the arrowhead O. On these right and left cartridge mounting guides 21, as shown in FIG. 5, the groove-shaped first and second guides 21*a*, 21*b* in two stripes for guiding the three guides 22, 23 and 24 are so provided oppositely in the long side direction of the process cartridge B respectively.

The first guide 21*a*, provided on a lower portion of the cartridge mounting guide 21, guides the elongated guide 23 and the cylindrical guide 22 provided on the process cartridge B. On this first guide 21*a*, a main guide part 21*a*1, a stepped part 21*a*2, a relieved part 21*a*3, a subguide part 21*a*4 and a positioning groove 21*a*5 are provided from upstream to downstream relative to the mounting direction (direction of the arrowhead C) of the process cartridge B. The main guide part 21*a*1 serves to guide the elongated guide 23 and the cylindrical guide 22. Besides, the subguide part 21*a*4 serves to guide the cylindrical guide 22 to the positioning groove 21*a*5. Furthermore, the positioning groove 21*a*5 serves to fit onto the cylindrical guide 22 and define the position of the process cartridge B. Still further, the second guide 21*b* is provided on an upper portion of the cartridge mounting guide 21 and guides the short guide 24 provided on the process cartridge B. On this second guide 21*b*, a rising slant 21*b*1 and a relief part 21*b*2 are provided from upstream to downstream, relative to the mounting direction of the process cartridge B.

By inserting the process cartridge B along these guides 21*a* and 21*b* and closing the openable and closable member 35, the mounting of the process cartridge B to the main body A of the apparatus is completed. Incidentally, as shown in FIG. 5, the process cartridge B is mounted to and demounted from the main body A of the apparatus in the direction crossing the axis (center line in the long side direction) of the photosensitive drum 7. More specifically, it is done from the direction substantially perpendicular to the axis.

Figure 5:
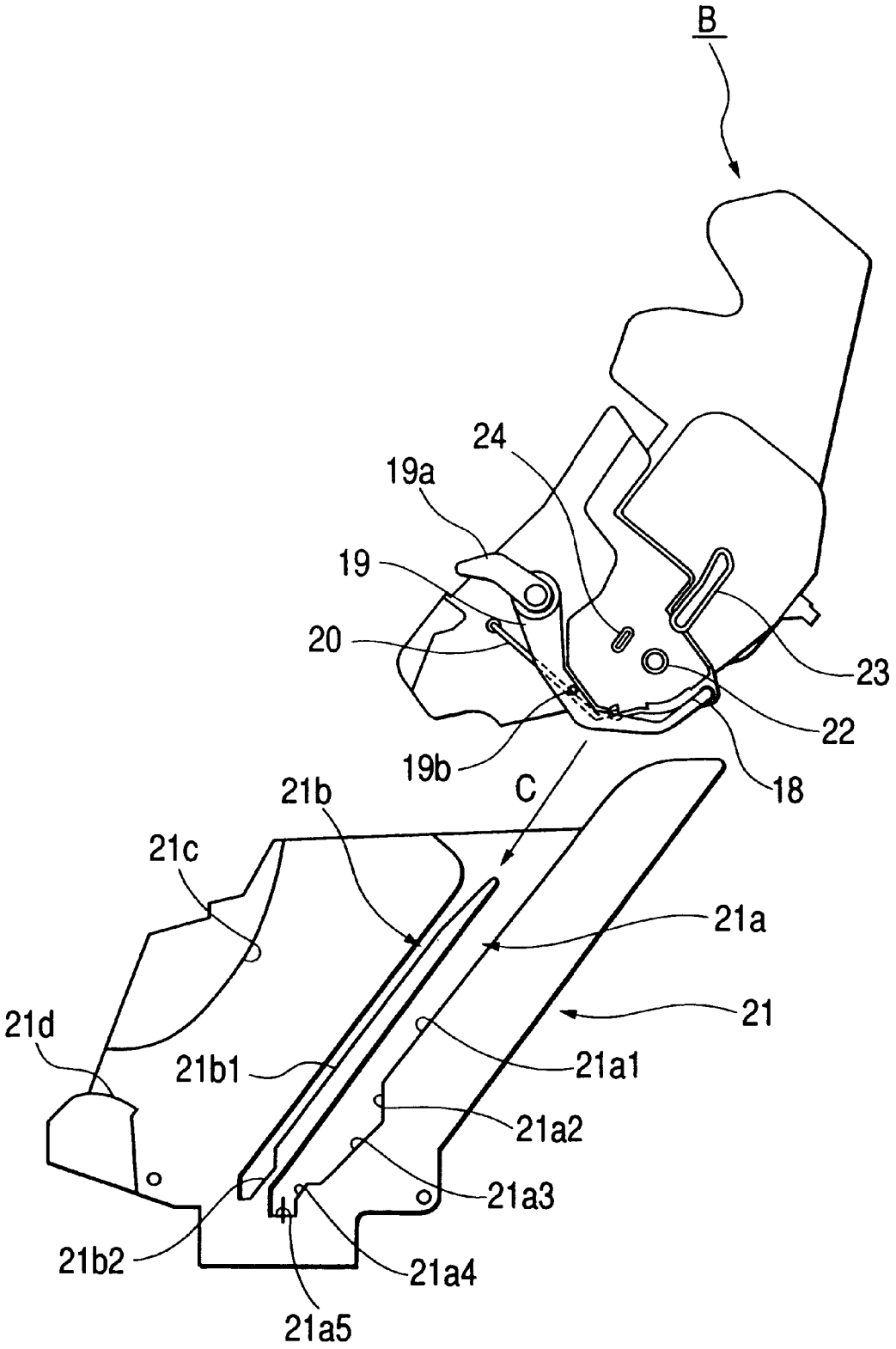
FIG. 5 is an illustration of an operation in mounting a process cartrige according to EMBODIMENT 1 to a main body of an image forming apparatus.
Figure 6:
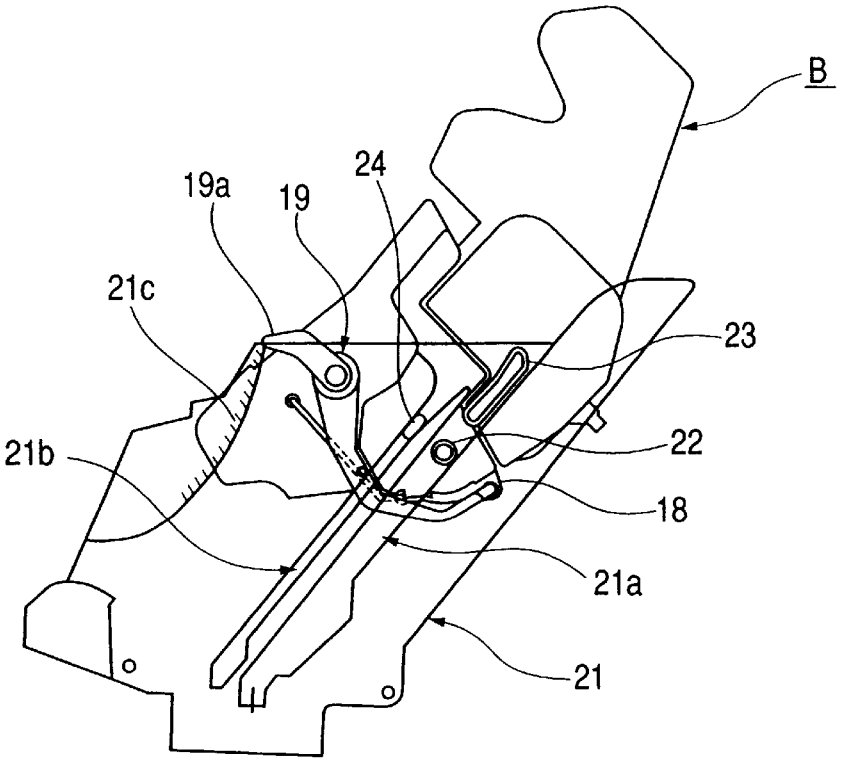
FIG. 6 is an illustration of an operation in mounting a process cartrige according to EMBODIMENT 1 to a main body of an image forming apparatus.
Figure 7:
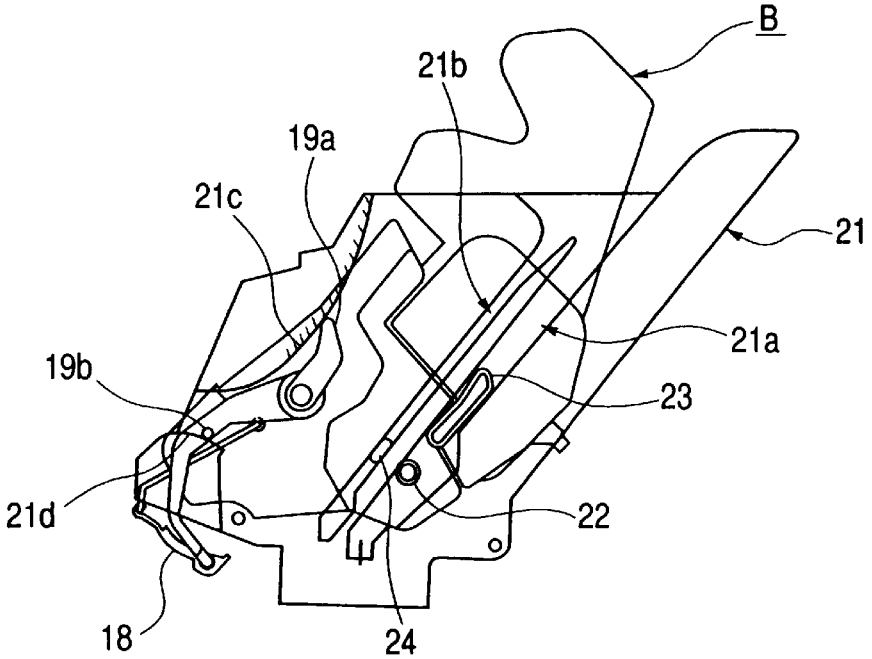
FIG. 7 is an illustration of an operation in mounting a process cartrige according to EMBODIMENT 1 to a main body of an image forming apparatus.

In FIG. 5, the numeral 21*c* denotes a first cam with which the distant end of the lever 19*a* fastened to the arm 19, connecting to the drum shutter 18 of the process cartridge B, is in sliding contact and the numeral 21*d* denotes a second cam for regulating the movement of the arm 19 by contacting the protrusion 19*b* of the arm 19 in the opening operation step of the drum shutter 18.

(Opening and Closing Operation of Drum Shutter)

Figure 8:
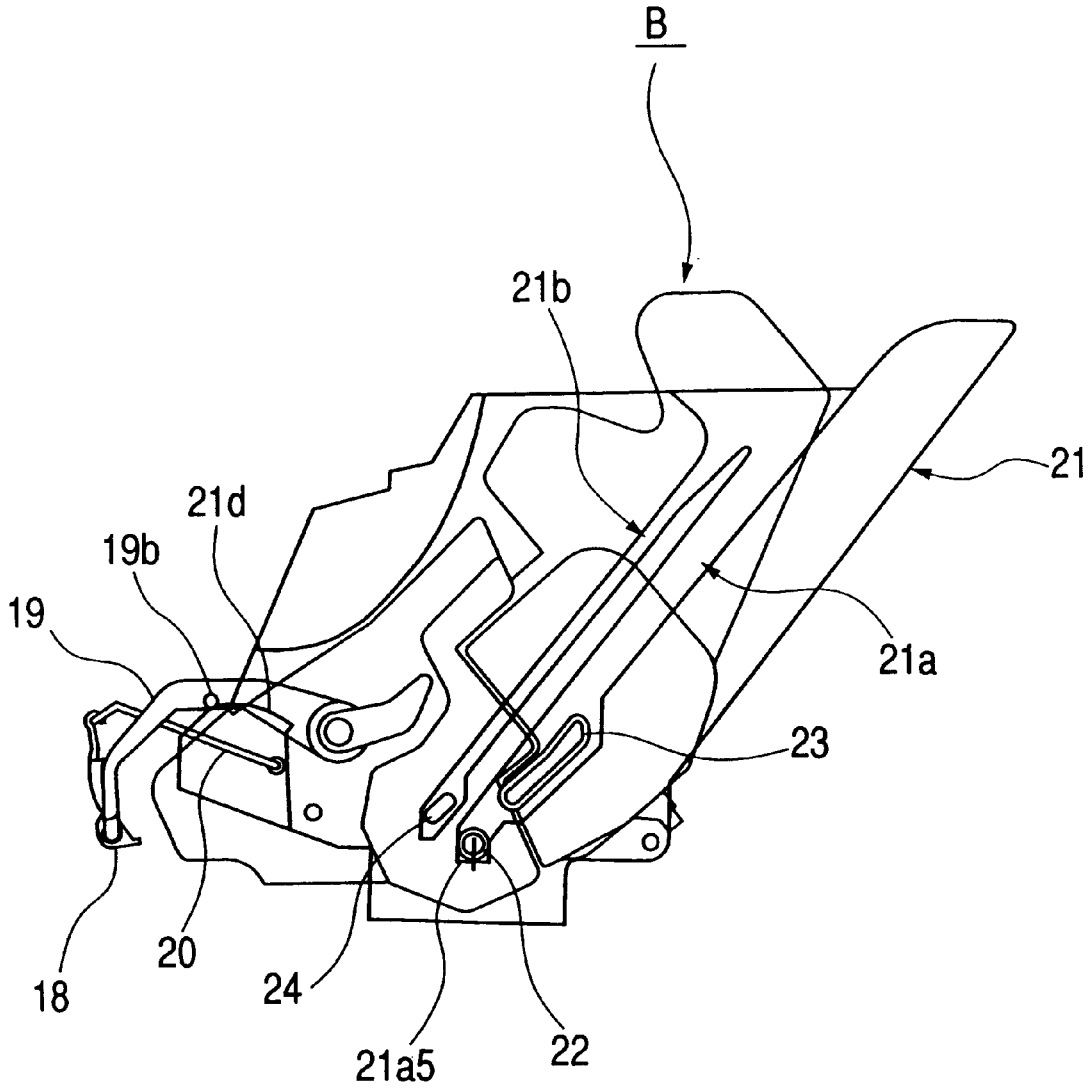
FIG. 8 is an illustration of an operation in mounting a process cartrige according to EMBODIMENT 1 to a main body of an image forming apparatus.

Next, the opening and closing operations of the drum shutter will be described referring to FIGS. 5 to 8. When mounting the process cartridge B to the main body A of the apparatus, the process cartridge B is inserted in the direction of the arrowhead C so that the cylindrical guide 22 and the elongated guide 23 on the side of the process cartridge B enter the first guide 21*a* of the mounting guide 21 and the short guide 24 enters the second guide 21*b* of the mounting guide 21. When these guides 22, 23 and 24 are guided down by the guides 21*a* and 21*b* to insert the process cartridge B up to the position shown in FIG. 6, the lever 19*a* of the arm 19 abuts against the first cam 21*c* and the drum shutter 18 begins to open. As the process cartridge B is inserted further, the lever 19*a* moves along the first cam 21*c* and the drum shutter 18 is going to open. When the process cartridge B reaches the position of FIG. 7, the protrusion 19*b* of the arm 19 contacts the second cam 21*d*, thereby regulating the movement of the arm 19. And, by falling of the cylindrical guide 22 of the process cartridge B into the positioning groove 21*a*5 of the mounting guide 21, as shown in FIG. 8, the process cartridge B is positioned and the drum shutter 18 opens completely. During this time, the locus of the drum shutter 18 is determined by the arm 19 and the link 20 mounted rotatably to the shutter. Besides, at a removal of the process cartridge B from the main body of the apparatus, the drum shutter 18 closes to protect the photosensitive drum 7 following the reverse operation to this.

Like this, according to the drum shutter 18 and the process cartridge B shown in this embodiment, two kinds of supporting parts 18*b* and 18*c* provided on the drum shutter 18 for rotatably supporting the link 20 for opening and closing the drum shutter 18 relative to the photosensitive drum 7 are provided with the cut-away portions 18*b*1 and 18*c*1, which are partially cut away respectively but differ in the cutting direction of the respective cut-away portions 18*b*1 and 18*c*1 of the relevant supporting parts 18*b* and 18*c*, so that a removal of the link 20 can be prevented by the support of the second supporting part 18*c*, for example, even though an unreasonable force is applied to the link 20 when an operator mounts the process cartridge B to the main body A of the apparatus with a stronger force than required or even though a force is applied to the link 20 in the direction of removing the link 20 from the first supporting part 18*b* by the interference between the drum shutter 18 and the main body A of the apparatus.

Other Embodiments:

With the drum shutter 18 shown in EMBODIMENT 1, the case that nails 18*d* (protrusive portions) for preventing the shutter shaft 20*a* of the link 20 from removing are provided on the opening ends of the cut-away portion 18*b*1 of the first supporting part 18*b* is exemplified, but the above nails 18*d* may be provided on the opening ends of the cut-away portion 18*c*1 of the second supporting part 18*c*.

Besides, with the process cartridge B shown in EMBODIMENT 1, the case of forming a monochromatic image is exemplified, but a plurality of developing means may be provided and another embodiment is appropriately applicable to a cartridge for forming a multi-color image (e.g., two color, three color or full-color image).

Besides, electrophotographic photosensitive members are not limited to the photosensitive drum 7, but their examples include the following. First, a photoconductor is used as a photosensitive member and examples of photoconductors include amorphous silicon, amorphous selenium, zinc oxide, titanium oxide and organic photoconductor (OPC) and so on. Besides, as a shape for loading the photoconductors, drum-shaped or belt-shaped ones are used and drum-shaped photosensitive members, for example, are those with a photoconductor evaporation deposited or coated on a cylinder made of aluminum alloy.

Besides, also for developing method, various developing methods such as a well-known two-component magnetic brush development, a cascade development, a touch-down development and a cloud development can be used.

Besides, as a configuration of charging means, a so-called contact-charging method was used in the embodiments mentioned above, it is natural that another configuration comprising a metal shield, such as aluminum on three sides of a tungsten wire used formerly, transporting positive or negative ions formed under application of a high voltage to the tungsten wire to a surface of a photosensitive drum and uniformly charging the surface of the photosensitive drum may be used.

Incidentally, in addition to the roller type, a blade (charging blade) type, a pad type, a block type, a rod type, a wire type and so on may be available for charging means.

Besides, also as cleaning means for removing the residual toner on the photosensitive drum, cleaning means may be constructed using a blade, a fur brush, a magnetic brush or the like.

Besides, the process cartridge B comprises, e.g. an electrophotographic photosensitive member and at least one process means acting on the electrophotographic photosensitive member. Accordingly, in addition to the above embodiments, an aspect of integrating an electrophotographic photosensitive member, developing means as process means and charging means as process means into a cartridge and making the process cartridge detachably mountable to the main body of the image forming apparatus, an aspect of integrating an electrophotographic photosensitive member and developing means as process means into a cartridge and making the process cartridge detachably mountable to the main body of the image forming apparatus, an aspect of integrating an electrophotographic photosensitive member, developing means as process means and cleaning means as process means into a cartridge and making the process cartridge detachably mountable to the main body of the image forming apparatus, etc. may be used as process cartridge.

Still further, in the above embodiments, a laser beam printer was exemplified as electrophotographic image forming apparatus, but the present invention need not be limited to this and it is natural that an electrophotographic copier, a facsimile device or a word processor, for example, can be used for an electrophotographic image forming apparatus.

According to the above embodiments, a plurality of supporting parts for rotatably supporting a link differ in cutting direction of their provided cut-away portions. Consequently, even though a strong force in the direction of removing the link from one cut-away portion, the link is securely supported by other supporting parts, thereby preventing the link from coming off. Thus, the removal of a link occurring in mounting and demounting a process cartridge B from the main body A of an apparatus can be avoided.

According to the present invention, as described above, the removal of a supporting member from a shutter member can be prevented.

While the invention has been described with reference to the structures disclosed herein, it is not confined to the details set forth and this application is intended to cover such modifications or changes as may come within the purposes of the improvements or the scope of the following claims.

What is claimed is:

1. A shutter member used for a process cartridge detachably mountable to a main body of an electrophotographic image forming apparatus, comprising:

a shutter part for partly covering an electrophotographic photosensitive drum of said process cartridge when mounted to said process cartridge;

a supporting member with its distant end attached to a frame of said process cartridge for supporting said shutter part on said process cartridge; and a first and a second attachment parts provided on said shutter part for attaching said supporting member to said shutter part, wherein said first attachment part and said second an attachment part differ in attachment direction for attaching said supporting member.

2. The shutter member according to claim 1, wherein said first attachment part and said second attachment part are disposed apart from each other along a long-side direction of said shutter part on.

3. The shutter member according to claim 2, wherein said first attachment part is disposed on each of one end and the other end of said shutter part in the long-side direction and said second attachment part is disposed between said first attachment parts in the long-side direction of said shutter part.

4. The shutter member according to claim 2, wherein said first and said second attachment parts each has a recessed portion for attaching said supporting member and a cut-away portion for allowing said supporting member to intrude into said recessed portion and said first and said second attachment parts differ in the cutting direction of said cut-away portion.

5. The shutter member according to any one of claims 1, 2, 3 and 4 wherein said supporting member is a link.

6. A process cartridge detachably mountable to a main body of an electrophotographic image forming apparatus, comprising:

(a) an electrophotographic photosensitive drum;

(b) process means for acting on said electrophotographic photosensitive drum;

(c) a cartridge frame; and (d) a shutter for covering a portion of said electrophotographic photosensitive drum exposed from said cartridge frame, movable between a protective position for covering said electrophotographic photosensitive drum and a retractive position for retracting from said protective position;

wherein said shutter includes:

a shutter part for partly covering the electrophotographic photosensitive drum;

a supporting member with its distant end attached to said cartridge frame to support said shutter part on said process cartridge; and first and second attachment parts provided on said shutter part for attaching said supporting member to said shutter part, wherein said first attachment part and said second an attachment part differ in attachment direction for attaching said supporting member.

7. The process cartridge according to claim 6, wherein said first attachment part and said second attachment part are disposed apart from each other along a long side direction of said shutter part.

8. The process cartridge according to claim 7, wherein said first attachment part is disposed on each of one end and the other end of said shutter part in the long-side direction and said second attachment part is disposed between said first attachment parts in the long-side direction of said shutter part.

9. The process cartridge according to claim 7, wherein said first and said second attachment parts each has a recessed portion for attaching said supporting member and a cut-away portion for allowing said supporting member to intrude into said recessed portion and said first and said second attachment parts differ in the cutting direction of said cut-away portion.

10. The process cartridge according to any one of claims 6, 7, 8 and 9 wherein said supporting member is a link.

11. The process cartridge according to any one of claims 6, 7, 8 and 9 wherein said process means includes at least one of developing means for developing a latent image formed on said electrophotographic photosensitive drum, charging means for charging said electrophotographic photosensitive drum and cleaning means for removing residual toner remaining on said electrophotographic photosensitive drum.

12. A process cartridge detachably mountable to a main body of an electrophotographic image forming apparatus, comprising:

(a) an electrophotographic photosensitive drum;

(b) developing means for developing a latent image formed on said electrophotographic photosensitive drum;

(c) charging means for charging said electrophotographic photosensitive drum;

(d) cleaning means for removing residual toner remaining on said electrophotographic photosensitive drum;

(e) a cartridge frame; and (f) a shutter for covering a portion of said electrophotographic photosensitive drum exposed from said cartridge frame, movable between a protective position for covering said electrophotographic photosensitive drum and a retractive position for retracting from said protective position;

wherein said shutter includes:

a shutter part for partly covering an electrophotographic photosensitive drum;

a supporting member with its distant end attached to said cartridge frame to support said shutter part on said process cartridge; and first and second attachment parts provided on said shutter part for attaching said supporting member to said shutter part; wherein said first attachment part and said second attachment part differ in an attachment direction for attaching said supporting member, wherein said first attachment part and said second attachment part are disposed apart from each other along a long-side direction of said shutter part, and said first attachment part is disposed on each of one end and the other end of said shutter part in the long-side direction and said second attachment part is disposed between said first attachment parts in the long side direction of said shutter part, and said first and said second attachment parts each has a recessed portion for attaching said supporting member and a cut-away portion for allowing said supporting member to intrude into said recessed portion and said first and said second attachment parts differ in the cutting direction of said cut-away portion.

13. A shutter member for protecting an electrophotographic photosensitive member of a process cartridge detachably mountable to a main body of an image forming apparatus, comprising: a plurality of support parts for rotatably supporting a link for opening and closing said shutter member with respect to said electrophotographic photosensitive drum in association with mounting and demounting operations of said process cartridge, wherein said plurality of support parts each has a cut-away portion for incorporating said link and at least one of said support parts has a cut-away portion different in the cutting direction from the other cut-away portions of the other support parts.

14. The shutter member according to claim 13, wherein a whole circumference of said link is supported by said plurality of support parts.

15. The shutter member according to claim 13 or 14, wherein at least one of said plurality of support parts is provided with a protrusive portion at an opening end thereof for preventing said link from coming off.

16. A process cartridge detachably mountable to a main body of an image forming apparatus, comprising:

an electrophotographic photosensitive member;

at least one process means for acting on said electrophotographic photosensitive member;

a cartridge frame for supporting said electrophotographic photosensitive member and said at least one process means and having an opening portion for opening a part of said electrophotographic photosensitive member outside;

a shutter member for protecting the part of said electrophotographic photosensitive member opened from the opening portion of said cartridge frame; and a link for supporting said shutter member on said cartridge frame so as to open and close the opening portion of said cartridge frame in association with the mounting and demounting operations of said process cartridge, wherein said shutter member includes a plurality of support parts with a cut-away into which said link intrudes, rotatably supporting said link and at least one of said support parts has a cut-away portion which differs in the cut-away direction from the others.

17. The process cartridge according to claim 16, wherein a whole circumference of said link is supported by said plurality of support parts.

18. The process cartridge according to claim 16 or 17, wherein at least one of said plurality of support parts is provided with a protrusive portion at an opening end thereof for preventing said link from coming off.

19. The process cartridge according to claim 16 or 17, wherein said process means includes at least one of charging means for charging said electrophotographic photosensitive member, developing means for developing a latent image forming on said electrophotographic photosensitive member with a developer and cleaning means for removing residual developer remaining on said electrophotographic photosensitive member.

20. The process cartridge according to claim 18, wherein said process means includes at least one of charging means for charging said electrophotographic photosensitive member, developing means for developing a latent image forming on said electrophotographic photosensitive member with a developer and cleaning means for removing residual developer remaining on said electrophotographic photosensitive member.

* * * * *

UNITED STATES PATENT AND TRADEMARK OFFICE

CERTIFICATE OF CORRECTION

PATENT NO. : 6,144,821
DATED : November 7, 2000
INVENTOR(S) : Toru Oguma

It is certified that error appears in the above-identified patent and that said Letters Patent is hereby corrected as shown below:

Column 1,
Line 55, "," should be deleted, and "member" (second occurrence) should read -- member, --.
Line 57, "member," should read -- member --.

Column 2,
Line 65, "irradiates" should read -- irradiates, --.
Line 66, "to" (first occurrence) should be deleted.

Column 3,
Line 42, "member" should read -- member, --.

Column 4,
Line 30, "to" should be deleted.

Column 8,
Line 51, "as" should read -- as an --.

Signed and Sealed this

Sixth Day of November, 2001

*Attest:*

Nicholas P. Godici

*Attesting Officer*

NICHOLAS P. GODICI
*Acting Director of the United States Patent and Trademark Office*